United States Patent [19]

Donnelly et al.

[11] 3,947,795

[45] Mar. 30, 1976

[54] TRANSFORMER WINDING MEANS AND METHODS

[75] Inventors: Donald E. Donnelly, Edwardsville, Ill.; Jerry W. McElroy, St. Louis; Arlie H. Ehlmann, Barnhart, both of Mo.

[73] Assignee: Emerson Electric Co., St. Louis, Mo.

[22] Filed: Aug. 12, 1974

[21] Appl. No.: 496,388

[52] U.S. Cl. ..... 336/184; 336/84; 336/96; 336/192; 336/198

[51] Int. Cl.[2] ..... H01F 27/30

[58] Field of Search ..... 336/198, 208, 192, 184, 336/96, 84, 134, 180, 185

[56] References Cited

UNITED STATES PATENTS

| | | | |
|---|---|---|---|
| 790,581 | 5/1905 | Lovejoy | 336/134 |
| 1,703,408 | 2/1929 | Smith | 336/192 X |
| 1,891,456 | 12/1932 | Smith | 336/198 X |
| 1,960,033 | 5/1934 | Smith | 336/198 X |
| 2,343,725 | 3/1944 | Wilson | 336/96 X |
| 2,355,477 | 8/1944 | Stahl | 336/198 X |
| 3,150,230 | 9/1964 | Goodman | 336/192 X |
| 3,354,417 | 11/1967 | Davis | 336/192 X |
| 3,553,621 | 1/1971 | Lane | 336/192 |
| 3,665,358 | 5/1972 | Leuck et al. | 336/198 X |

FOREIGN PATENTS OR APPLICATIONS

| | | | |
|---|---|---|---|
| 150,315 | 6/1955 | Sweden | 336/198 |

*Primary Examiner*—Thomas J. Kozma
*Attorney, Agent, or Firm*—Paul A. Becker, Sr.

[57] ABSTRACT

A transformer winding having a very large number of turns of wire is divided into a plurality of connected portions each wound on a separate flanged bobbin with the start end and the finish end of each winding portion secured to radial tabs on the bobbin flanges. The wound bobbins are mounted end to end on an iron core and the winding portions thereon are connected in series. Alternate methods of connecting the winding portions in series are also disclosed.

6 Claims, 8 Drawing Figures

TRANSFORMER WINDING MEANS AND METHODS

This invention relates to transformers and particularly to improved winding means and methods for transformer windings having a very large number of turns of wire.

BACKGROUND OF THE INVENTION

Since the advent of insulative spools or bobbins, many transformer windings which were previously layer wound are now bobbin wound. It is well known in the art that bobbin winding, which can be completely automated, is inherently faster and more economical than layer winding. However, some windings, such as those consisting of a very large number of turns, have heretofore continued to be layer wound because it is impractical to wind all the wire on a single bobbin. For example, such a single bobbin winding would require a relatively narrow winding space in order to withstand the voltages between layers of turns and especially the high transient voltages produced at the instants when the winding is energized and de-energized. Such a narrow winding space would consequently require a large number of layers which would result in winding size which would be unacceptable when used in devices in which the overall size of the device is somewhat standard in the industry. Furthermore, such a single bobbin winding would not overcome another disadvantage of a layer wound coil having a very large number of turns, namely the scrap loss incurred when the wire breaks while winding, such breakage being a fairly common occurrence with the high speed winding machines presently used.

SUMMARY OF THE INVENTION

In accordance with the present invention, a transformer winding having a very large number of turns of wire comprises a plurality of series connected bobbin windings, wherein each bobbin is wound with a portion of the transformer winding. Improved methods of series connecting the bobbin winding portions are also disclosed.

In one preferred embodiment of the invention, the secondary winding of an ignition transformer comprises eight identical bobbin winding portions. Each winding portion has a start end wrapped several times around an anchoring tab which extends radially from one of the bobbin flanges, and a finish end wrapped several times around an opposed anchoring tab which extends radially from the other bobbin flange. The bobbin winding portions are mounted end to end on spaced parallel legs of an iron core in a pair of banks of four adjacent portions, with the anchoring tabs aligned, and electrically connected in series. The electrical connection is accomplished by wrapping a continuous wire around the adjacent pairs of tabs and the single end tabs over the start ends and finish ends, applying solder at the tabs to join the continuous wire structurally and electrically with the start ends and the finish ends, and cutting off and removing the portions of the continuous wire extending between the flanges of each bobbin.

An object of the present invention is to provide improved winding means and methods for a transformer winding having a very large number of turns of wire, in which such winding means and methods are automatable and economical.

A further object is to provide such a winding means in which a plurality of bobbins are individually wound with a portion of the transformer winding, each portion having a start end and a finish end; in which means extending radially from the periphery of each bobbin provides means for securing the start end and the finish end of each winding portion; and in which the finish ends are connected to the start ends so that all winding portions are connected in series.

A further object is to provide improved methods for series connecting such bobbin winding portions.

Other objects and advantages of the present invention will become apparent from the following description when read in connection with the accompanying drawings.

DESCRIPTION OF THE PREFERRED EMBODIMENTS

Figure 1:
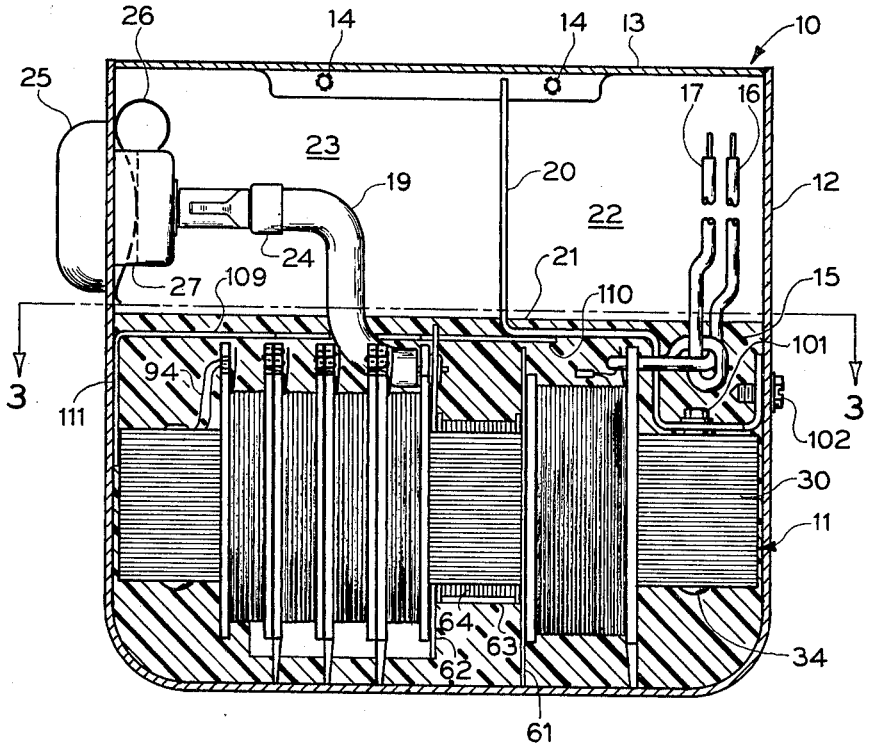
FIG. 1 is a partially sectionalized front elevation view of an ignition transformer utilizing the bobbin winding means and methods of the present invention.

Referring to FIG. 1, the invention is illustrated by reference to an ignition transformer device indicated generally at 10, comprising transformer 11 enclosed in a generally rectangular-shaped housing 12 having an open end attached to a base plate 13 by any suitable means such as by screws 14. The purpose of the ignition transformer device 10 is to supply a high voltage, approximately 10,000 volts, to spark-producing electrodes (not shown) to ignite vaporized oil in an oil burning unit (not shown). The base plate 13 is provided with mounting means (not shown) for mounting to such an oil burning unit.

Figure 2:
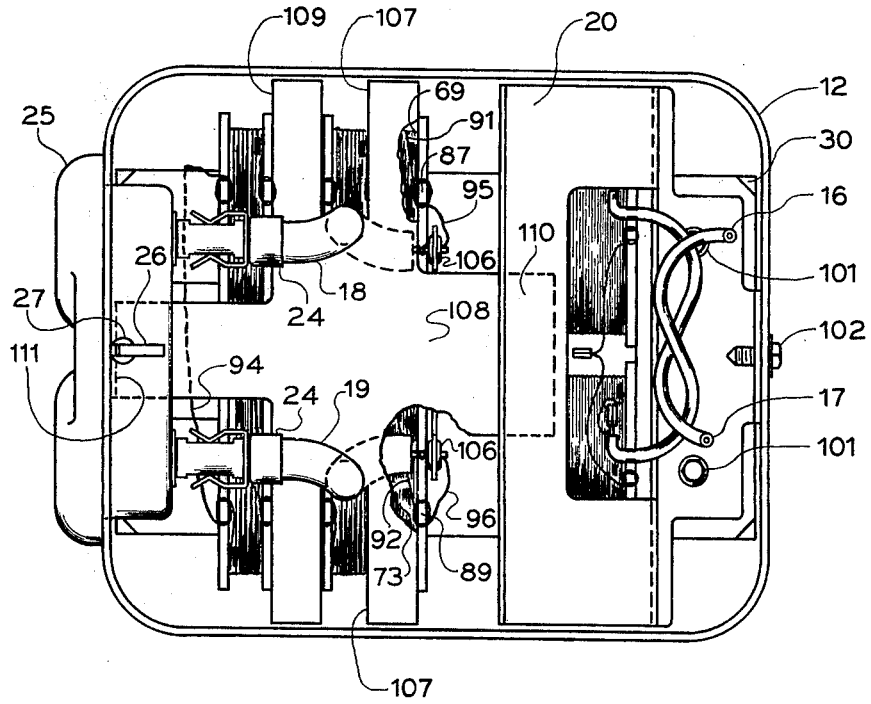
FIG. 2 is a top plan view of the ignition transformer of FIG. 1 with the base plate removed and shown prior to potting, and having sections of an insulator broken away to show the connections of secondary lead wires to the bobbin-wound secondary winding.

Transformer 11 is embedded in an insulative potting compound 15, out of which insulated primary windings 16 and 17, insulated secondary winding leads 18 and 19, see FIG. 2 for location of lead 18, and a grounding bracket 20 exit. Bracket 20, base plate 13, housing 12, and the top surface 21 of potting compound 15 define a primary wiring chamber 22 in which primary leads 16 and 17 are connected to power leads (not shown) from a suitable 120-volt alternating current power source (not shown), and a secondary wiring chamber 23 in which secondary lead wires 18 and 19, provided with connecting means 24, are connected to a high voltage insulative bushing 25. Referring to FIGS. 1 and 2, bushing 25 is mounted in one side of housing 12 and secured by means of a clip spring 26 which passes through a hole 27 in bushing 25 and bears against the inside wall of housing 12. Bushing 25 is adapted to receive high voltage lead wires (not shown) for connection to the spark producing electrodes (not shown). It is to be understood that the bushing 25 and the connection means 24 on secondary leads 18 and 19 may be of any well-known suitable construction, the details of which are beyond the scope of this invention.

Figure 3:
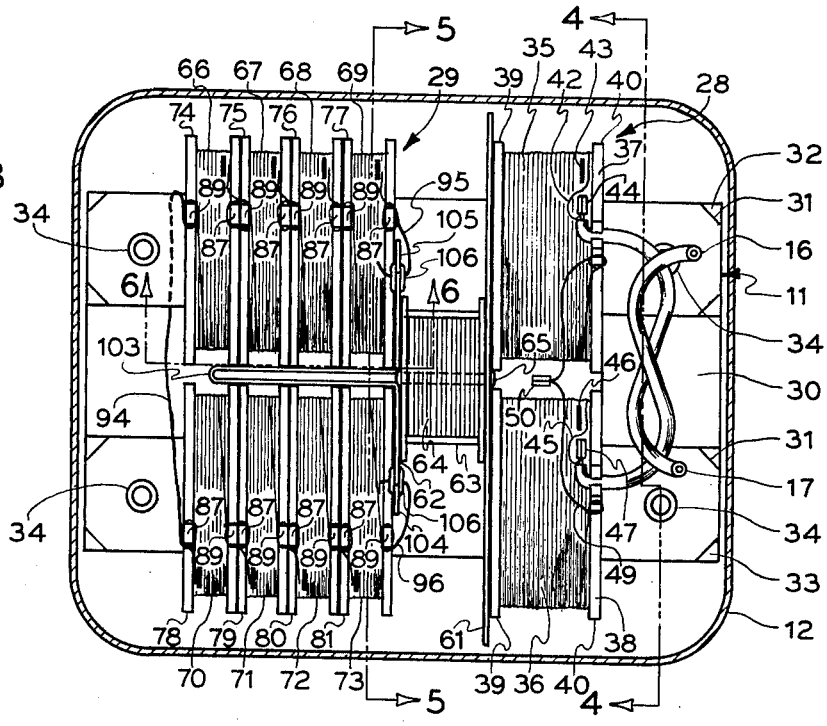
FIG. 3 is a cross-sectional view of the ignition transformer taken along line 3—3 of FIG. 1, with the potting compound, insulator, grounding plate, and secondary lead wires removed.

Referring now to FIG. 3, transformer 11 comprises a primary winding indicated generally at 28 and a secondary winding indicated generally at 29, both mounted on a magnetic core member 30 having a plurality of U-l laminations. As shown more clearly in FIG. 4, the laminations are securely sandwiched between keeper plates 31, which extend along and on both sides of parallel spaced legs 32 and 33 of core member 30, by rivets 34 passing through apertures in the laminations and keeper plates 31, rivets 34 being counterbored at their coined ends for a reason to be hereinafter explained.

Primary winding 28 comprises two identical winding portions 35 and 36 mounted in opposed relationship on legs 32 and 33, respectively, of core member 30. Each of the winding portions 35 and 36 is wound with approximately two hundred and fifty turns of number 22 gauge wire on identical bobbins 37 and 38, which are preferably made of a polyester material. Each of the bobbins 37 and 38 has end flanges 39 and 40 defining a winding space for the winding portions 35 and 36.

The start end 42 of winding portion 35, insulated from the remainder of winding portion 35 by any suitable means, such as a piece of tape 43, is connected to a stripped end of primary lead wire 17 by a crimp-type connector 44. Similarly, the start end 45 of winding portion 36 is insulated from the remainder of winding portion 36 by a piece of tape 46 and is connected to a stripped end of the other primary lead wire 16 by connector 47. The finish end 48 of winding portion 35 is connected to the finish end 49 of winding portion 36 by a crimp-type connector 50, so that the flux produced when current flows through the series connected winding portions 35 and 36 will be in the same direction in core member 30.

Figure 4:
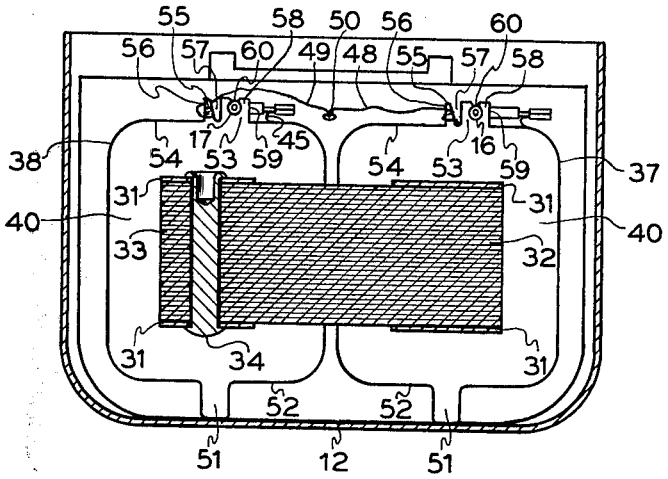
FIG. 4 is a cross-sectional view of the ignition transformer taken along line 4—4 of FIG. 3.

Referring now to FIG. 4, a spacing tab 51 extends radially from a peripheral edge 52 of end flange 40 of each of the primary winding bobbins 37 and 38. Tab 51 rests on the bottom wall of housing 12 to provide the desired spacing between housing 12 and the winding portions 35 and 36 on bobbins 37 and 38. A multi-slotted tab 53 extends radially from the opposite peripheral edge 54 of each of the bobbins 37 and 38 for purposes to be hereinafter described. A first portion 55 of tab 53 is defined by one of the sides 56 of tab 53 and a tapered slot 57. The respective finish ends 48 and 49 are wrapped several times around the first portions 55 prior to being joined by connector 50, so that the wire in winding portions 35 and 36 will not unravel during subsequent handling. A second portion 58 of tab 53, defined by the other side 59 of tab 53 and tapered slot 57, is provided with a slot 60 which is open to the top edge of portion 58 and is narrower than the diameter of insulated primary lead wires 16 and 17, which are insulated with a slightly compressible insulation such as a thermoplastic. The insulation on leads 16 and 17 is therefore compressed as they are forcibly inserted into slots 60 so that a considerable pulling force on leads 16 and 17, tending to remove the leads from slots 60, is resisted, thereby preventing such pulling force from being transmitted to start ends 42 and 45. It should be noted that pulling force on leads 16 and 17 is also resisted by the knotting of leads 16 and 17 below the top surface 21 of potting compound 15, as shown in FIG. 1.

Figure 5:
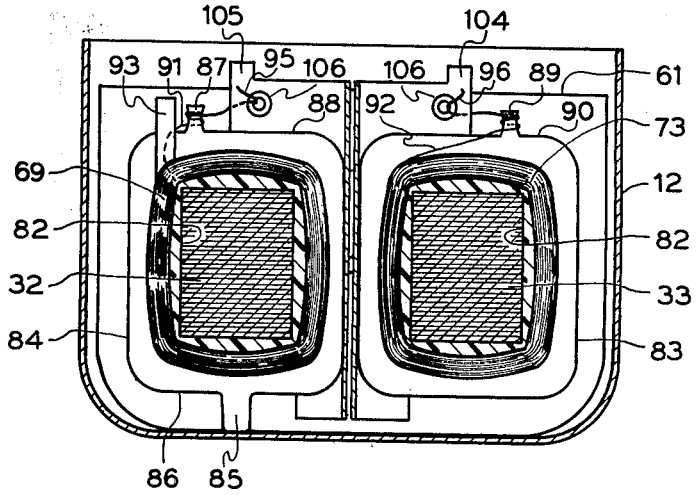
FIG. 5 is a cross-sectional view of the ignition transformer taken along line 5—5 of FIG. 3.

As shown in FIGS. 3, 4, and 5, disposed between primary winding 28 and secondary winding 29 is a flat plate 61 apertured to receive legs 32 and 33 of core member 30. The outer edges of plate 61 extend beyond the outer ends of the primary winding 28 and secondary winding 29 so as to provide an electrostatic shield to eliminate radio interference due to the high frequency waves generated by secondary winding 29 when sparking occurs across the electrodes.

As shown in FIG. 3, sandwiched between legs 32 and 33 of core member 30 and between plate 61 and an insulator 62, and insulated therefrom by a wrap-around insulator 63, is a laminated magnetic shunt 64. The laminations, secured together by a rivet 65, are at a ninety-degree angle with respect to the U-l laminations of core member 30, see FIG. 1. After conduction has started across the electrodes, shunt 64 provides a leakage flux path to limit the secondary current.

Secondary winding 29 comprises eight identical winding portions electrically connected in series to produce the desired secondary voltage between secondary leads 18 and 19. As shown in FIG. 3, four winding portions 66 to 69 are mounted end to end on leg 32 of core member 30, and four winding portions 70 to 73 are mounted end to end in opposed relationship to portions 66 to 69 on leg 33. Each of the winding portions is wound on identical bobbins 74, 75, 76, 77, 78, 79, 80, and 81, which are preferably made of a polyester material.

Figure 6:
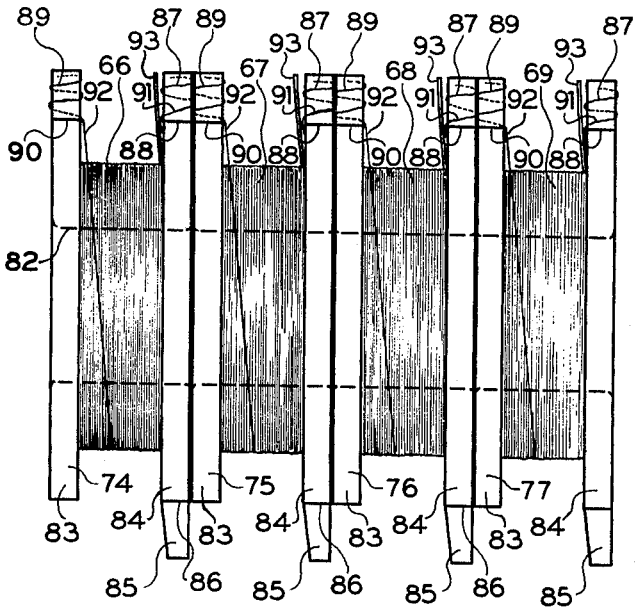
FIG. 6 is an enlarged front elevational view of the bank of individual bobbin winding portions taken along line 6—6 of FIG. 3, shown prior to being mounted on the core and prior to being series connected.

Referring now to FIG. 6, the bank of winding portions 66 to 69 is shown prior to connecting the winding portions in series. Each of the bobbins 74 to 77 has a rectangular axial opening 82 to receive leg 32 of core member 30 and is formed with flanges 83 and 84 at opposite ends to define a winding space. A spacing tab 85 extends radially from a peripheral edge 86 of flange 84 of each of the bobbins to provide the desired spacing between housing 12 and winding portions 66 to 69, as shown in FIG. 5 for winding portion 69. A short anchoring tab 87 extends radially from the opposite peripheral edge 88 of flange 84. Another anchoring tab 89, identical to tab 87, extends radially from peripheral edge 90 of flange 83 in opposed relationship to tab 87, so that adjacent tabs 87 and 89 of winding portions 66 to 69 are aligned.

Each of the winding portions 66 to 69 is identically wound with approximately 5,250 turns of number 41 gauge wire, wherein the start end 91 is wrapped around tab 87 and the finish end 92 is wrapped around tab 89. Any suitable means, such as a piece of tape 93, is used to insulate each start end 91 from the remainder of each of the respective winding portions 66 to 69. After being individually wound, winding portions 66 to 69 are then mounted end to end, as shown in FIG. 3, on leg 32 of core member 30 through axial opening 82 in each of the bobbins 74 to 77. The other bank, comprising winding portions 70 to 73, is rotated 180° with respect to the bank of winding portions 66 to 69 and is mounted on leg 33 of core member 30.

Figure 6A:
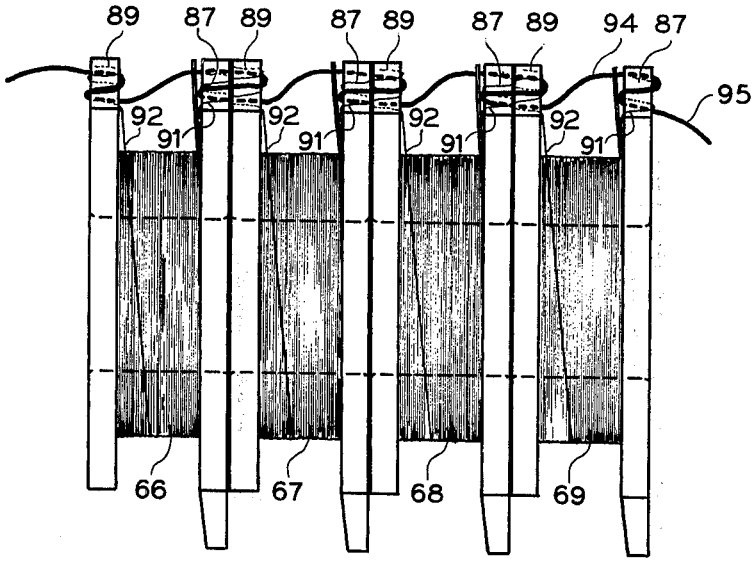
FIG. 6A shows a step in one preferred embodiment of the method of series connecting the bobbin winding portions of FIG. 6.

Referring now to FIG. 6A, to connect all winding portions in series, a continuous strand of wire 94, having a start end 95 is wrapped several times around single end tab 87 over at least a portion of start end 91 of winding portion 69. Wire 94 is then wrapped several times around adjacent tabs 89 and 87 of winding portions 69 and 68, over at least a portion of finish end 92 of winding portion 69, and over at least a portion of start end 91 of winding portion 68. Similarly, wire 94 is wrapped around adjacent tabs 89 and 87 of winding portions 68 and 67, around adjacent tabs 89 and 87 of winding portions 67 and 66, and around single end tab 89 of winding portion 66.

Referring to FIG. 3, wire 94 is then routed between keeper plate 31 and the adjacent lamination of leg 32 of core member 30, for a reason to be hereinafter explained, and wrapped around single end tab 87 of winding portion 70. In the same manner as wire 94 is wrapped around the tabs 87 and 89 in winding portions 66 to 69, wire 94 is wrapped around adjacent pairs of tabs 89 and 87 of adjacent winding portions 70-71, 71-72, 72-73, and around single end tab 89 of winding portion 73, leaving a finish end 96.

The connections at the single end tabs 87 and 89 and at adjacent tabs 89 and 87 are then soldered, preferably by wave soldering, wherein solder joins wire 94 structurally and electrically to the portions of the start ends 91 and finish ends 92 which are wrapped around tabs 87 and 89. Wave soldering is preferred because it is an automatable process and thus is more economical.

It should be noted that wave soldering is facilitated by the arrangement of winding portions 66 through 73 in a pair of opposed banks and by the bobbin construction wherein tabs 87 and 89 extend radially from peripheral edges 88 and 90 of bobbins 74 through 81 a sufficient distance so that solder can be applied exclusively to the vicinity of tabs 87 and 89. After the soldering operation, those portions of the continuous strand of wire 94 between tabs 87 and 89 in each winding portion 66 through 73 is cut and removed, leaving only the start end 95, the finish end 96, and the portion between tab 89 of winding portion 66 and tab 87 of winding portion 70, and resulting in all winding portions 66 through 73 being electrically connected in series between start end 95 and finish end 96.

Figure 7:
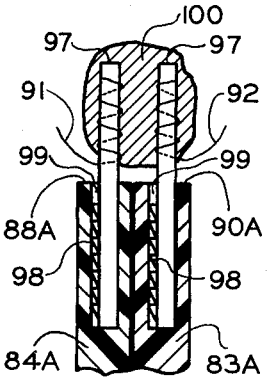
FIG. 7 is an enlarged cross-sectional view of portions of two adjacent individual bobbin winding portions with conductive anchoring tabs connected by solder, illustrating an alternate means for series connecting the individual bobbin winding portions.

An alternate construction which enables another method of electrically connecting winding portions 66 through 73 in series is illustrated in FIG. 7, wherein parts similar to those previously described are indicated by like reference numerals followed by the reference letter "A." Instead of tabs 87 and 89, a metal terminal 97, having claw-like barbs 98 formed on one end, is securely embedded in an opening 99 in each of the bobbin flanges 83A and 84A. Terminals 97 extend radially from peripheral edges 88A and 90A to provide conductive anchoring tabs for each respective start end 91 and finish end 92. With this construction, solder 100 will adhere to metal terminals 97 and to at least a portion of start ends 91 and finish ends 92, and the globule of solder is sufficiently large to bridge the gap between terminals 97. Therefore, this construction negates wrapping wire 94 around adjacent terminals 97 and the subsequent cutting of wire 94 between terminals 97 in each winding portion 66 through 73, and wire 94 need only provide start end 95, finish end 96, and the portion connecting the two banks of winding portions 66 through 73.

The portion of wire 94 clamped between keeper plate 31 and the adjacent lamination of leg 32 of core member 30 effectively grounds the midpoint of secondary winding 29 to housing 12. Referring to FIGS. 1 and 2, grounding bracket 20 is secured to core member 30 by means of screws 101 threadedly engaged into the counterbored coined end of two of the tubular rivets 34, rivets 34 being shown more clearly in FIG. 4, and bracket 20 is secured to housing 12 by means of a screw 102. By grounding the midpoint of the secondary winding 29, the highest voltage potential between any of the winding portions and core member 30 will be one-half what it would be if secondary winding 29 were grounded at either end, thus reducing the insulating requirements of each of the bobbins 74 through 81. Referring to FIG. 3, the maximum secondary voltage between start end 95 and finish end 96 of wire 94 is approximately 10,000 volts. Because of grounding the midpoint of secondary winding 29, the maximum voltage between winding portion 69 and core member 30 and, alternately, between winding portion 73 and core member 30 is 5,000 volts.

Referring to FIG. 3, a folded-over central portion 103 of insulator 62 prevents arcing between the bank of winding portions 66 to 69 and the opposing bank of winding portions 70 to 73. Flat, opposing legs 104 and 105 of the insulator 62 extend perpendicular to central portion 103, and each of said legs is apertured to receive a metal eyelet 106. Eyelets 106 provide a relatively fixed means, remote from winding portions 66 through 73, for connecting secondary lead wires 18 and 19 to the start end 91 of winding portion 69 and the finish end 92 of winding portion 73. Referring to FIGS. 3 and 5, the start end 95 of wire 94 is inserted through eyelet 106 in leg 105 and the finish end 96 of wire 94 is inserted through eyelet 106 in leg 104.

Referring to FIG. 2, start end 95 and finish end 96 are wrapped around stripped ends of secondary leads 18 and 19, and the stripped ends of leads 18 and 19 are then inserted through eyelets 106. Solder (not shown) is then applied at eyelets 106 which structurally and electrically connects start end 95 and finish end 96 to secondary leads 18 and 19 and to eyelets 106, so that a considerable pulling force on leads 18 and 19 is prevented from being transmitted to tab 89 of winding portion 73, tab 89 being wrapped with finish end 92 of winding portion 73, and to tab 87 of winding portion 69, tab 87 being wrapped with start end 91 of winding portion 69.

Referring to FIGS. 1 and 2, secondary leads 18 and 19 are preferably positioned for a desired exit location from the potting compound 15 by a pair of opposed U-shaped slots 107, approximately as wide as the diameter of leads 18 and 19, in the horizontal portion 108 of an L-shaped insulator 109. Prior to potting, the leads 18 and 19 are inserted into slots 107 so that leads 18 and 19 are seated in the bottom of slots 107 so as to provide a predetermined spaced relationship between leads 18 and 19. Preferably, the leads 18 and 19 are then knotted above the insulator 109 so as to bias leads 18 and 19 against the bottom of slots 107 until the potting compound 15 is sufficiently cured to maintain the spaced relationship. Insulator 109 is itself prevented from movement prior to potting in that one end 110 of the horizontal portion 108 is located beneath a portion of grounding bracket 20, a section of the horizontal portion 108 extends substantially the width of housing 12, and a portion 111 perpendicular to the horizontal portion 108 is clamped between housing 12 and core member 30.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a transformer, a primary winding, a secondary winding, an iron core having spaced parallel portions, both said windings being mounted in inductive relationship with said iron core, said secondary winding being wound on a plurality of insulative bobbins apertured for receiving therein said core, each of said bobbins being formed with flanges at opposite ends to define a winding space for a portion of said secondary winding, each of said winding portions having a start end and a finish end, a first anchoring tab extending radially from the peripheral edge of one of said flanges of each of said bobbins and around which said start end of each of said winding portions is wrapped, a second anchoring tab extending radially from the peripheral edge of the other of said flanges of each of said bobbins and around which said finish end of each of said winding portions is wrapped, said bobbins and winding portions being mounted end to end in a pair of banks on said parallel iron core portions with said radial tabs in alignment, a first means for electrically connecting said finish ends and start ends on said adjacent second and first tabs so that said adjacent winding portions in each of said banks are connected in series, a second means for electrically connecting said finish end on said second tab of a last bobbin in one of said banks to said start end on said first tab of a first bobbin in the other of said banks so that said banks are connected in series, and a third means for electrically connecting said start end on said first tab of a first bobbin in said one of said banks to a secondary winding lead and for electrically connecting said finish end on said second tab of a last bobbin in said other of said banks to another secondary winding lead so that said banks are connected in series between said secondary leads.

2. The transformer claimed in claim 1 which further includes means disposed between said third connecting means and said secondary winding leads for securing said third connecting means and said secondary winding leads and thus protecting said start end on said first tab of said first bobbin in said one of said banks and said finish end on said second tab of said last bobbin in said other of said banks from a mechanical pull.

3. The transformer claimed in claim 1 in which said primary winding is wound on a pair of insulative bobbins apertured for receiving therein said core, each of said primary winding bobbins being formed with flanges at opposite ends to define a winding space for a portion of said primary winding, each of said primary winding portions having a start end and a finish end, said finish ends being connected to each other, and said start ends being connected to a pair of primary winding leads.

4. The transformer claimed in claim 3 which further includes means in one of said flanges of each of said primary winding bobbins for securing said primary winding leads and thus protecting said start ends from a mechanical pull.

5. The transformer claimed in claim 3 which further includes means in one of said flanges of each of said primary winding bobbins for securing said finish ends of said primary winding portions before being connected to each other.

6. In a transformer, a primary winding, a secondary winding, an iron core having spaced parallel portions, both said windings being mounted in inductive relationship with said iron core, said secondary winding being wound on a plurality of insulative bobbins apertured for receiving therein said core, each of said bobbins being formed with flanges at opposite ends to define a winding space for a portion of said secondary winding, each of said winding portions having a start end and a finish end, a first conductive anchoring tab extending radially from the peripheral edge of one of said flanges of each of said bobbins, means securing said start end of each of said winding portions to said first tabs, a second conductive anchoring tab extending radially from the peripheral edge of the other of said flanges of each of said bobbins, means securing said finish end of each of said winding portions to said second tabs, said bobbins and winding portions being mounted end to end in a pair of banks on said parallel iron core portions with said radial tabs in alignment, a first means for electrically connecting said adjacent second and first tabs so that said adjacent winding portions in each of said banks are connected in series, a second means for electrically connecting said second tab extending from a last bobbin in one of said banks to said first tab extending from a first bobbin in the other of said banks so that said banks are connected in series, and a third means for electrically connecting said first tab extending from a first bobbin in said one of said banks to a secondary winding lead and for electrically connecting said second tab extending from a last bobbin in said other of said banks to another secondary winding lead so that said banks are connected in series between said secondary leads.

* * * * *